United States Patent [19]

Strom-Olsen et al.

[11] Patent Number: 5,003,291

[45] Date of Patent: Mar. 26, 1991

[54] FERROMAGNETIC FIBERS HAVING USE IN ELECTRONICAL ARTICLE SURVEILLANCE AND METHOD OF MAKING SAME

[76] Inventors: John O. Strom-Olsen, 443 Lansdowne Ave., Montreal, Canada, H3Y 2V4; Piotr Z. Rudkowski, 5067 Bourassa, Pierrfonds, Canada, H8Z 2K1

[21] Appl. No.: 290,547

[22] Filed: Dec. 27, 1988

[51] Int. Cl.[5] ..... G08B 13/24

[52] U.S. Cl. ..... 340/551; 340/572

[58] Field of Search ..... 340/551, 572; 361/402; 164/463

[56] References Cited

U.S. PATENT DOCUMENTS

| | | | |
|---|---|---|---|
| Re. 32,428 | 5/1987 | Gregor et al. | 340/572 |
| 3,790,945 | 2/1974 | Fearon | 340/572 |
| 4,369,557 | 1/1983 | Vandebult | 340/572 X |
| 4,527,614 | 7/1985 | Masumoto et al. | 164/463 |
| 4,568,921 | 2/1986 | Pokalsky | 340/572 |
| 4,710,754 | 12/1987 | Montean | 340/572 |
| 4,818,312 | 4/1989 | Benge | 340/572 X |
| 4,829,288 | 5/1989 | Eisenbeis | 340/551 |
| 4,857,891 | 8/1989 | Heltemes | 340/551 |
| 4,940,596 | 7/1990 | Wright | 427/47 |

OTHER PUBLICATIONS

Institutional Research, Sep. 1987; pp. 10–11, Knogo Corporation.

"The Chameleon . . . A Quantum Leap Forward in Electronic Article Surveillance"; (Advertisment, May, 1986), Knogo Corporation.

*Primary Examiner*—Glen R. Swann, III

*Assistant Examiner*—Thomas J. Mullen, Jr.

*Attorney, Agent, or Firm*—Melvin J. Scolnick; David E. Pitchenik; Peter Vrahotes

[57] ABSTRACT

A ferromagnetic fiber has been fabricated that has particular use in the field of electronic article surveillance (EAS). The ferromagnetic fiber is produced by using a spinning disk type of device that engages a bath of molten alloy having the desired compositions for the fiber. The use of ferromagnetic fibers has resulted in the ability to produce EAS markers of such a small length that they can be dispensed using a commercial labeler.

35 Claims, 1 Drawing Sheet

FERROMAGNETIC FIBERS HAVING USE IN ELECTRONICAL ARTICLE SURVEILLANCE AND METHOD OF MAKING SAME

BACKGROUND OF THE INVENTION

The unauthorized taking of articles of merchandise has long been a problem for retail stores. Various efforts have been made to prevent such unauthorized taking, commonly called "shoplifting". Picard devised an electronic article surveillance system of the electromagnetic type as disclosed in his French patent application No. 763,681 published in 1934. The Picard system included a transmitter, a receiver and a ferromagnetic marker. Attempts have been made tc reduce the size and cost of markers for article surveillance purposes as proposed in U.S. Pat. No. 4,568,921 to Pokalsky granted Feb. 4, 1986. In accordance with the disclosure of the Pokalsky patent, the drawn wire marker element is about 0.127 mm (127 microns) in diameter and, more importantly, the marker element itself is about 76.2 millimeters in length. U.S. Pat. No. Re. 32,427 to Gregor granted May 26, 1987 relates to a marker element which is an elongated, ductile strip of amorphous ferromagnetic material that retains its signal identity after being flexed or bent.

SUMMARY OF THE INVENTION

A method has been devised for formulating ferromagnetic fibers for use in markers. By marker is meant any object that can be detected by a sensing system after the marker has been placed in a magnetic field of appropriate characteristics. The instant invention includes a ferromagnetic fiber, or fibers, supported in any appropriate manner. The fibers can be detected in an interrogation zone, which fibers can have a length of less than ⅝ of an inch (15 mm). It has been found that one of the important parameters of the ferromagnetic fibers is the aspect ratio. Fibers having a diameter of approximately 100 microns, or less, have been found suitable for producing a marker, such as a label, of a length of approximately 15 mm or less. It will be appreciated that the length can be longer if desired.

Another important parameter is the method by which the ferromagnetic fiber is produced. Rapid solidification techniques are used in which the fibers are cast directly into their final physical dimension and with which no subsequent mechanical or thermal treatment is required to carrying out the invention. Fibers produced by rapid solidification techniques are in a state of stress, and molecular orientation that is favorable with regard to its magnetic properties as cast.

It is an object of the invention to provide an improved marker for an electronic article surveillance system having a ferromagnetic marker element which is substantially shorter than prior art markers and which is low in cost and yet provides effective electromagnetic response in the system.

It is another object of the invention to provide an improved electromagnetic marker for use in an electronic article surveillance system wherein the marker element is either a crystalline or amorphous fiber made by rapid solidification techniques.

It is yet another object of the invention to provide an improved method of making an electromagnetic marker for use in an electronic article surveillance system, wherein the marker element is made by rapid solidification techniques.

It is another object of the invention to provide an improved marker for use in an electronic surveillance system, wherein one or more ferromagnetic marker elements are mounted in a random orientation on a suitable carrier, for example, on a record member such as a ticket, tag or label.

It is still another object of the invention to provide an improved marker for use in an electronic article surveillance system wherein crystalline ferromagnetic material such a permalloy is used, and wherein the marker element is ductile enough to be manipulated without losing its signal identity.

It is a further object of the invention to provide an improved marker for an electronic article surveillance system wherein a marker element comprises a fiber woven into a fabric.

It is a further object of the invention to provide an improved marker for use in an electronic article surveillance system wherein a marker element is directly incorporated into paper.

It is another object of the invention to provide an improved process of making a marker for use in an electronic article surveillance system wherein one or more marker elements are incorporated into a papermaking slurry which is subsequently rolled into paper, wherein the resulting paper is detectable by the system.

It is another object of the invention to provide an improved marker for use in an electronic article surveillance system, wherein the marker includes a marker element having a shape and stress which yields favorable ferromagnetic properties.

It is another object of the invention to provide an improved marker for use in an electronic article surveillance system, wherein the marker includes a marker element having a ferromagnetic fiber which no greater than 15 mm in length.

It is another object of this invention to provide a marker having at least one sheet that supports one or more ferromagnetic fibers.

It is still another object of this invention to provide an improved low cost, ferromagnetic marker element.

It is yet another object of this invention to produce a ferromagnetic marker element in a one step method that results in a ready to use product.

It is another object of this invention to provide a ferromagnetic material useful in shielding magnetic fields.

It is another object of the invention to provide an improved marker for use in an electronic article surveillance system, wherein the marker includes a ferromagnetic marker element having a cross-sectional area less than $6\times10^{-3}$ mm$^2$.

It is yet another object of the invention to provide an improved marker for use in an electronic article surveillance system, wherein the marker element includes a ferromagnetic fiber having a maximum transverse dimension of less than 80 microns.

It is another object of the invention to provide an improved marker for use in an electronic article surveillance system, wherein the marker element includes a ferromagnetic fiber having a weight of less than 20 milligrams. It is still another object of this invention to provide a ferromagnetic marker that can be used in contemporary commercial labellers.

DETAILED DESCRIPTION OF THE PREFERRED EMBODIMENT

Figure 1:
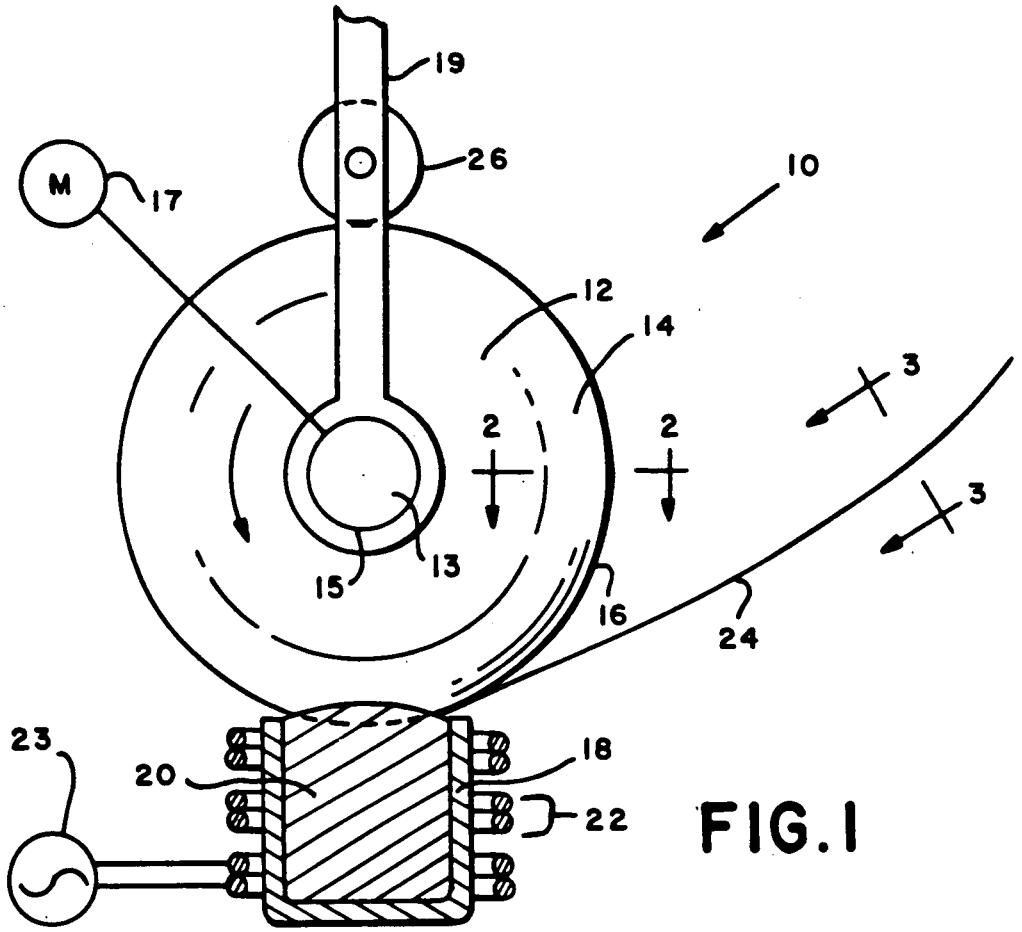
FIG. 1 is a longitudinal cross sectional view of a melt extraction device for producing ferromagnetic fibers.
Figure 2:
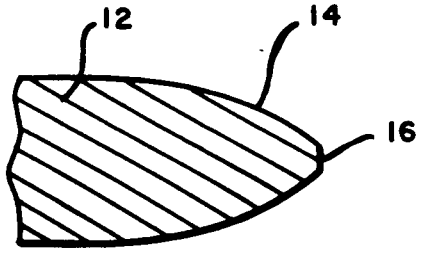
FIG. 2 is an enlarged, cross sectional view taken along the lines 2—2 of FIG. 1 of the perimeter of the spinning disk shown in FIG. 1.
Figure 3:
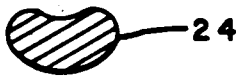
FIG. 3 is a cross sectional view taken along the lines 3—3 of FIG. 1 showing the cross section a fiber produced by the device of FIG. 1.

Referring initially to FIGS. 1-3, a rotating-wheel device capable of producing rapid solidification is shown generally at 10 that produces ferromagnetic fibers in accordance with the principles of the instant invention. What is shown and will be described is a melt extraction technique but it will be appreciated that other techniques can be used in practicing the invention including melt spinning, melt drag and pendent drop method. The important requirement is that the material be of a shape such as those which will be described and solidifies rapidly. The device 10 includes a disk 12, or wheel, which is fixedly supported by a rotatable shaft 13 and has a reduced section 14 at its perimeter. The reduced section 14 has an edge 16. The disk 12 used in the reduction to practice of the invention had a diameter of six inches and the edge 16 had a radius of curvature of approximately 30 microns, but 5 to 50 microns would be acceptable. The shaft 13 is in engagement with a motor 17 by any convenient means so that the shaft, and the disk 12 that is mounted thereon, can be rotated.

A cup shaped tundish 18 is disposed below the disk 12 and is adapted to receive a metal alloy composition 20. Induction coils 22 are disposed around the tundish 18 and are connected to a source of power 23. Upon sufficient power being applied to the coils 22, the metal alloy composition 20 within the tundish 18 will become molten. The disk 12 is rotated as indicated by the arrow in FIG. 1 and upon the disk rotating within the molten alloy composition, it will produce a fiber 24. Optionally, in contact with the flange 14 is a wiper 26 made of a material such as cloth for the purpose of keeping the reduced section 14 clean.

Figure 4:
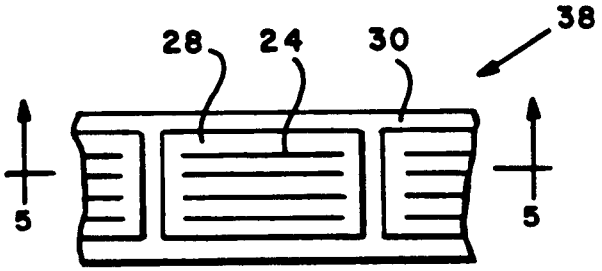
FIG. 4 is a plan view of a composite web including fibers made by the device shown in FIG. 1.
Figure 5:
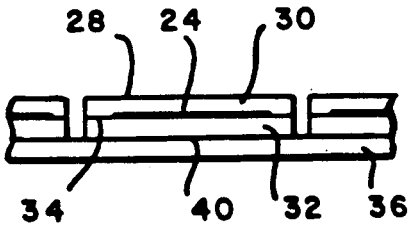
FIG. 5 is a cross sectional view taken along the lines 5—5 of FIG. 4 showing a side elevational view of the composite web.

Referring now to FIGS. 4 and 5, the fibers 24 are aligned relative to one another and located between upper and lower sheets 30,32, respectively, that are joined by an adhesive 34 to form a marker which is shown in the form of a label 28. The labels 28 are supported by a web 36 and can be applied to the surface of an article through use of a labeller as is known in the art. As used in this disclosure, the term label is intended to include tickets and tags as well. Reference can be had to U.S. Pat. No. 4,207,131 for details of a carrier web described herein. Preferably, the marker 28 has a length of less than one inch and preferably about ⅝". With such a size, the composite web 38 can be used in a commercial labeler such as an 1110 labeler available from Monarch Marking Systems Inc., Dayton Ohio. Although the marker 28 is shown with upper and lower sheets, 30,32, it will be appreciated that the fibers 24 can be adhered to the lower sheet 32 only and the upper sheet can be eliminated.

The source of power 23 is enabled so as to cause the induction coils to heat the metal alloy 20 above its melting point thereby creating a molten bath of metal alloy. As will be noted, the reduced section 14 of the disk 12 extends into the metal 20. Although the metal is shown having a dome appearance thereon, this is slightly exaggerated for purposes of showing the reduced section 14 being received within the melt. In any case, a portion of the diameter of the disk 12 will extend below the upper most portions of the tundish to engage the metal alloy 20 after the metal alloy has reached its appropriate temperature. Depending upon the temperature of the alloy, the arm 19 will be lowered so as to place the reduced section 14 within the metal alloy and the motor 17 will be enabled thereby rotating the disk 12. The disk 12 will be rotated in the direction as shown by the arrow in FIG. 1 and a fiber of ferromagnetic metal 24 will be formed thereby. This fiber 24 can be as long as is required.

It will be appreciated that the rapid solidification process described will produce a fiber that is in ready to use condition i.e., it goes from the molten state directly to the solid state in a state for immediate use. No subsequent treatment is required to achieve the properties sought. This is in contrast to prior ferromagnetic materials such as wires and permalloy foils where mechanical and/or thermal treatment is required to obtain the necessary properties.

In keeping with this invention, a ferromagnetic fiber is defined as a generally elongated article composed either of amorphous or crystalline ferromagnetic material, having a diameter from 3 to 80 microns, an aspect ratio, i.e. length to diameter ratio, of at least 150 and a magnetic switching time at half amplitude points ($t_{\frac{1}{2}}$) of less than 10 microseconds at a sine wave driving frequency of 6 kH and amplitude in the order of one Oersted. The fiber produced by the above apparatus has a cross section, which is shown in FIG. 3, that is generally kidney-shaped. One particular fiber was kidney shaped and had a dimension of 30-80 micrometers in one direction, and 20 to 30 micrometers in the other direction. As the speed of the disk 12 was increased, the fiber 24 assumed a more oval shape, as opposed to kidney-shaped, and eventually would have a circular cross-section with a narrow groove if the diameter of the fibers were 15 microns or less. Best results were achieved with a fiber 24 having a generally circular cross section.

Under optimum conditions, the fiber 24 could be of indefinite length, but it has been found that certain conditions affect the length of the fiber. The conditions that cause variation in the length of the fiber are rotational velocity of the disk 12, vibrations in the system and shape and design of the disk.

Figure 6:
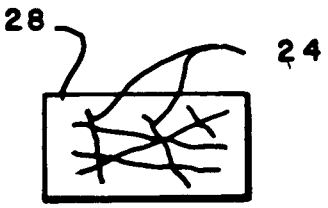
FIG. 6 is a plan view showing an alternative distribution of fibers within a label.

The fiber 24 was cut into lengths of approximately ¾ of an inch and placed upon a first layer 32 of a label. A second layer 30 was placed over the fiber 24, in registration with the first layer, and with adhesive therebetween so as to form a label. The fibers 24 may be placed in aligned spaced relationship, as shown in FIG. 4, approximately one mm apart, or they can be located within the label in random fashion as shown in FIG. 6. It has been found that 3 or more fibers placed in alignment would be sufficient for the marker to be sensed in an interrogation zone; whereas, when the fibers were placed in random fashion, 5 or more fibers were sufficient. Placing the fibers 24 in random fashion, overlapping one another is unique in the field. Previous markers required multiple elements be aligned with and/or sequential from one another. Other orientations are possible. One or more fibers coiled, bent or curved can also provide acceptable responses for detection. It was found that the minimum total weight of fibers 24 that are detectable was approximately 0.2 milligrams.

A large number of compositions were formulated for the purpose of producing fibers 24. The following is a table of some of the compositions that were explored with the physical form and test results of the system.

| COMPOSITION | FORM | $t_{\frac{1}{2}}$(ls) |
|---|---|---|
| $Fe_{70}Al_{25}Cr_5$ | C | 5 |
| $Fe_{70}Al_{24.8}Cr_5C_{0.1}P_{0.1}$ | C | 10 |
| $Fe_{69}Al_{26}Cr_5$ | C | 3 and 5 |
| $Fe_{72}Al_{25}Cr_3$ | C | 7 and 8 |
| $Fe_{72}Al_{28}$ | C | 6 |
| $Fe_{72}Al_{25}Cr_3$ | C | 7 |
| $Fe_{70}Al_{25}Cr_5$ | C | 5 |
| $Ni_{72}Cu_{14}Mo_3Fe_{11}$ | C | 2 |
| $Ni_{72}Cu_{14}Cr_3Fe_{11}$ | C | 3 |
| $Ni_{72}Cu_{13}Mo_2Mn_2Fe_{11}$ | C | 4 |
| $Ni_{71}Cu_{13}Mo_2Mn_3Fe_{11}$ | C | 2.4 |
| $Ni_{73}Cu_{13}Mo_2Mn_1Fe_{11}$ | C | 1.8 |
| $Ni_{79}Fe_{15}Mo_5Mn_1$ | C | 1.5 |
| $Ni_{82}Fe_{12}Cu_1Mo_3Mn_2$ | C | 2.5 |
| $Co_{70}Fe_4Si_{16}B_{10}$ | A | 2.4 |
| $Co_{69.6}Fe_{4.1}Mo_{0.9}Si_{17.5}B_{7.75}$ | A | 2.8 |
| $Fe_{78}Si_9B_{13}$ | A | 5.2 |
| $Fe_{74}Nb_8Si_6B_{12}$ | A | 2.7 |

where
C=crystalline
A=Amorphous
$t_{\frac{1}{2}}$=pulse measure in microseconds

In the determination of the performance of a ferromagnetic marker, perhaps the most critical parameter is the $t_{\frac{1}{2}}$ which is the measure of how sharp the pulse induced by such marker is in an interrogation zone. More Specifically, $t_{\frac{1}{2}}$ represents in microseconds the time lapse between rising and trailing portions at one half the peak value of the induced signal. A value of $t_{\frac{1}{2}}$ =10 micro seconds or less is considered acceptable. A lower value is desirable because this indicates a sharp, easy to detect peak and hence high harmonic content.

Although efforts have been made in the past to use crystalline ferromagnetic material, commonly known as permalloy, as an element in a marker, two factors inhibited its use. Firstly, in prior forms of permalloy elements the $t_{\frac{1}{2}}$ was too large for practical use in the EAS field. Secondly, because permalloy is crystalline, bending tended to alter its magnetic properties. With the instant invention, it has been found that these detrimental characteristics are sufficiently reduced to allow the use of permalloy. As stated previously, low quantities of ferromagnetic material in fibrous form is detectable in an interrogation zone.

In addition, it can be said that all ferromagnetic materials useful as an EAS marker element in the form of a ribbon are useful when in the form of a fiber. Reference can be made to U.S. Pat. No. Re. 32,427 for examples of such compositions.

In general the fiber can be formulated from a ferromagnetic material consisting essentially of the one of the formulas:

Fa Lb Oc where
F is iron
L is at least one of silicon or aluminum
O is at least one of chromium, molybdenum, vanadium, copper, manganese and
a ranges from about 60 to 90 atom percent
b ranges from about 10 to 50 atom percent
c ranges from about 0 to 10 atom percent
OR
Na Fb Mc where
N is nickel
F is iron
M is at least one of the copper molybdenum, vanadium, chromium, manganese, or other non magnetic elements and
a ranges from about 60 to 84 atom percent
b ranges from about 0 to 40 atom percent
c ranges from about 0 to 50 atom percent
OR
Ma Nb Oc Xd Ye Zf where
M is at lest one of the iron and cobalt,
N is nickel,
0 is at least one of chromium and molybdenum,
X is at least one of boron and phosphorous, Y is silicon, Z is carbon, and
"a" ranges from about 35–85 atom percent
"b" ranges from about 0–45 atom percent
"c" ranges from about 0–7 atom percent
"d" ranges from about 5–22 atom percent
"e" ranges from about 0–15 atom percent
"f" ranges from about 0–2 atom percent
and the sum of "d+e+f" ranges about 15–25 atom percent.

It should be noted that generally those fibers that are amorphous can be fabricated in an ambient environment; whereas, those fibers formed from crystalline compositions had to be formed in a vacuum or inert atmosphere, such as argon.

It has been found that all devices emphasizing the rapid change of magnetic flux resulting from changing the magnetization of a soft magnetic material will be enhanced by using the material in the form of fibers. Although the reasons that an electromagnetic fiber produced by rapid quenching results in a superior performance in the EAS field are not precisely known, calculations have been made that show a cylindrically shaped electromagnetic material is superior to the same material in the form of a ribbon.

Comparison of signal from a strip and a fiber

| | |
|---|---|
| B = 0.6 Tesla | Saturation magnetization of material |
| $l_m^S$ = $l_0$100,000 | Magnetic permeability of material |
| W = 2 p 6000 $sec^{-1}$ | Frequency of applied field |
| $H_m$ = 1.5 oersted | Applied field |
| G: = $\frac{1}{.3\ m}$ | Coupling factor to pickup coil |

-continued

Dimensions for a fiber (F) and a strip (S)

| | |
|---|---|
| length (ln) = 20 mm | width (w) = .8 mm |
| diameter (d) = 25 um | thickness (t) = 25 um |
| N = 10 | Number of turns on pickup coil |
| $n_f = 1$ | Number of fibers |

Effective magnetic permeability for a fiber l DF compared to a strip l DS taking into account the demagnetization effect.

$$l_{DF}(\ln,d) = 3.2\,\frac{l^{\frac{3}{2}}}{d} \qquad l_{DS}(\ln,w,t) = \frac{4\,p\,l^{\frac{3}{2}}}{14.25\,t\,w}$$

$$u_{DF}(\ln,d) = 67.31 \times 10^3 \qquad l_{DS}(\ln,w,t) = 3.279 \times 10^3$$

As is shown, the effective magnetic permeability for a ferromagnetic fiber is substantially larger than that of a ribbon.

Volume of magnetic material:

$$V_F(1,d) = p\,\frac{d^2}{4}\,1 \qquad V_S(\ln,w,t,) = w\,t\,l$$

Ratio of applied field to critical field for fiber (BF) and strip (BS):

$$BF(\ln,d) = \frac{l_m H_m}{B_S\left[1 + \frac{l_m}{l_0 l_{DF}(\ln,d)}\right.} \qquad BS(\ln,w,t): = \frac{l_m H_m}{B_S\left[1 + \frac{l_m}{l_0 l_{DS}(\ln,w,t)}\right]}$$

Decrease or roll off of signal from one harmonic to the next:

$$AF(\ln,d) = \frac{\sqrt{1 + = BF(\ln,d)^2 - \ln}}{BF(\ln,d)} \qquad AS(\ln,w,t) = \frac{\sqrt{\ln + BS\,(\ln,w,t)^2 - 1}}{BS(\ln,w,t)}$$

$$AF(\ln,d) = 0.821 \qquad AS(\ln,w,T) - 0.191$$

Signal at the ninth harmonic for a fiber (SF) and a strip (SS).

$$SF(\ln,d) = \frac{4}{p}\,B_S w V_S(\ln,d) AF(\ln,d)^9 n_f NG$$

$$SS(\ln,w,t) = \frac{4}{p}\,B_S w V_S(\ln,w,t) \cdot AS(\ln,w,t)^9 N_f NG$$

$$SF(\ln,d) = 3.674 \times 10^{-6}\ \text{volt} \qquad SS(\ln,w,t) = 2.783 \times 10^{-8}\ \text{volt}$$

$$\frac{SF(\ln,d)}{SS(\ln,w,t)} = 132.017 \qquad \text{Ratio of signals}$$

$$\frac{V_F(\ln,d)}{V_S(\ln,w,t)} = 0.025 \qquad \text{Ratio of material volumes}$$

As can be seen from the above calculations, the signal generated by a fiber is 132 times greater than a signal generated by a strip of equal length, 20 mm. It is recognized that the other dimensions of the strip can be altered to change the responsiveness of the strip, but the ratio of the dimensions selected were those considered typical.

Although the novel fiber of this invention has been discussed as it may be used in labels, it will be appreciated that there are other uses for such fibers. If made sufficiently small, the fibers can be woven as part of paper from which documents are made. In this way one would have an article with non-evident detecting capabilities. Still another use for which these fibers would be applied for the location and identification of structures such as cables, located below the ground, or other unaccessible structures. The threads could be formed as part of the cable that is laid underground and by appropriate detection means, the cables could be located even though they are not exposed. Another use would be shielding. For example, in the shielding of electrical cables from a magnetic field, a covering over the cables incorporating ferromagnetic fibers would tend to isolate the cables from the field. In still another use, the electromagnetic fibers can be added to a paper slurry from which paper having fibers therein can be produced. Such papers would be detectable and have great use where security is required, for example in the making of paper currency.

What is claimed is:

1. A marker for use in an electric article surveillance system, the marker comprising: a ferromagnetic fiber made by rapid solidification from a molten ferromagnetic alloy, and a carrier for said ferromagnetic fiber.

2. A marker for use in an electronic article surveillance system, the marker comprising: a ductile, flexible crystalline, ferromagnetic marker element for producing a detectable response and made by rapid solidification from a pool of a molten ferromagnetic alloy, and a carrier for said marker element.

3. A marker as defined in claim 2, wherein the carrier comprises a pressure sensitive label.

4. A marker as defined in claim 2, wherein the carrier comprises a tag.

5. A marker as defined in claim 2, wherein the carrier comprises fabric.

6. A marker as defined in claim 2, wherein the marker comprises paper into which the fiber is incorporated.

7. A marker as defined in claim 2, wherein the alloy is crystalline in its solid state.

8. A marker as defined in claim 2, wherein the alloy is amorphous in its solid state.

9. A marker for use in an electronic article surveillance system, the marker comprising: a marker element for producing a detectable response and including a ferromagnetic fiber made from a molten alloy, and a carrier for the marker element.

10. The marker as defined in claim 9 wherein said ferromagnetic fiber is produced from said molten alloy by rapid solidification techniques.

11. A marker for use in an electronic article surveillance system, the marker comprising: a rapidly solidified ferromagnetic fiber having a length less than 15 millimeters and cross-sectional area of less than $6\times10^{-3}$ square millimeters.

12. A marker as defined in claim 11, wherein the marker element has a $t_{\frac{1}{2}}$ value of less than 10 microseconds.

13. A marker for use in an electronic article surveillance system, the marker comprising: a rapidly solidified ferromagnetic marker element for producing a detectable response, and a carrier for the marker element.

14. Method of making a marker for use in an electronic article surveillance system, comprising the steps of: rapidly solidifying a ferromagnetic fiber from a pool of molten alloy, and incorporating the resulting fiber with a support.

15. Method as defined in claim 14, wherein the incorporating step includes incorporating the fiber into fabric.

16. Method as defined in claim 14, wherein the incorporating step includes adding fibers into a paper-making slurry, and converting the slurry into paper.

17. Method as defined in claim 14, further comprising the step of cutting the fiber into a plurality of fiber pieces, and wherein the incorporating step includes mounting the fiber pieces on a plurality of support members.

18. Method as defined in claim 17, wherein the cutting step includes cutting the fiber into a plurality of fiber pieces each having a predetermined length.

19. A marker for use in an electronic article surveillance system, the marker comprising: a support, a marker element for producing a detectable response supported by said support, the marker element including a ferromagnetic fiber and having a length no greater than 15 millimeters.

20. A marker as defined in claim 19, wherein the marker element has an aspect ratio of at least 150.

21. A marker for producing a detectable response in an electronic article surveillance system, the marker comprising: a support element and a ferromagnetic fiber supported by the support element, the fiber having a cross sectional area of less than $6\times10^{-3}$ square millimeters.

22. A marker for producing a detectable response in an electronic article surveillance system, the marker comprising: a support element, a ferromagnetic fiber supported by the support element, the fiber having a maximum transverse dimension of 80 microns.

23. A ferromagnetic marker for use in an article surveillance system comprising:

a ferromagnetic fiber having an aspect ratio of greater than 150, said ferromagnetic fiber being positioned between two dielectric sheets, and said sheets begin joined so as to hold said ferromagnetic fibers therebetween to form a marker.

24. The ferromagnetic marker of claim 23 wherein said ferromagnetic fiber is an amorphous metal.

25. The ferromagnetic marker of claim 23 wherein said ferromagnetic fiber is a crystalline metal.

26. The ferromagnetic marker of claim 23 wherein said marker has a length of less than one inch.

27. A ferromagnetic fiber having a nominal diameter of less than 80 microns and a $t_{\frac{1}{2}}$ of less than 10 microseconds in a driving frequency of 6 $kH_z$ and an amplitude in the order of one Oersted.

28. The fiber of claim 27 wherein said fiber has an aspect ratio greater than 150.

29. The fiber of claim 27 wherein said ferromagnetic fiber is amorphous.

30. The fiber of claim 27 wherein said ferromagnetic fiber is crystalline.

31. The fiber of claim 27 wherein said fiber has a kidney shaped cross section.

32. The fiber of claim 27 wherein said fiber has a generally circular cross section.

33. The fiber of claim 27 wherein said ferromagnetic material is an iron based crystalline alloy consisting essentially of the formula:

Fa Lb Oc where

F is iron

L is at least one of silicon or aluminum, and

O is at least one of chromium, molybdenum, vanadium, copper, manganese; and a ranges from about 60 to 90 atom percent, b ranges from about 10 to 50 atom percent and c ranges from about 0 to 10 atom percent.

34. The fiber of claim 27 wherein said ferromagnetic material comprises a crystalline alloy consisting essentially of the following formula:

Na Fb Mc where

N is nickel,

F is iron, and

M is at least one of copper, molybdenum, vanadium, chromium, or manganese; and a ranges from about 60 to 84 atom percent, b ranges from about 0 to 40 atom percent, and c ranges from about 0 to 50 atom percent.

35. The fiber of claim 27 wherein said ferromagnetic material comprises an alloy consisting essentially of the formula:

Ma Nb $O_c X_d Y_e Z_f$ where

M is at least one of iron or cobalt or a combination thereof

N is nickel

O is at least one of chromium and molybdenum

X is at least one of boron and phosphorous

Y is silicon

Z is carbon and a ranges from about 35–85 atom percent b ranges from about 0–45 atom percent c ranges from about 0–7 atom percent d ranges from about 5–22 atom percent e ranges from about 0–15 atom percent f ranges from about 0–2 atom percent and the sum of d+e+f ranges from about 15–25 atom percent.

* * * * *